United States Patent [19]

Selke et al.

[11] Patent Number: 4,815,687

[45] Date of Patent: Mar. 28, 1989

[54] C-BRACKET FOR MEDICAL EQUIPMENT

[75] Inventors: Gary J. Selke, Kirkland; Larry J. Morse, Redmond, both of Wash.

[73] Assignee: SiMed Corporation, Bothell, Wash.

[21] Appl. No.: 107,629

[22] Filed: Oct. 9, 1987

[51] Int. Cl.[4] ..... A47B 96/06

[52] U.S. Cl. ..... 248/230; 248/161; 248/231.7; 248/309.1

[58] Field of Search ..... 248/230, 225.31, 231.7, 248/122, 121, 161, 155, 125, 674, 309.1, 312.1

[56] References Cited

U.S. PATENT DOCUMENTS

| | | | |
|---|---|---|---|
| 884,772 | 4/1908 | Sorensen | 248/225.31 X |
| 1,561,432 | 11/1925 | Hitchcock | 248/230 |
| 1,798,572 | 3/1931 | Welton | 248/230 X |
| 1,854,478 | 4/1932 | Meyers | 248/230 |
| 2,810,136 | 10/1957 | Kearney | 248/312.1 X |
| 3,069,019 | 12/1962 | Schuster | 248/312.1 X |
| 4,307,864 | 12/1981 | Benoit | 248/230 X |

*Primary Examiner*—Ramon O. Ramirez
*Attorney, Agent, or Firm*—Seed & Berry

[57] ABSTRACT

The subject invention is directed toward a novel bracket for releasably supporting medical testing and monitoring equipment. The bracket includes a support member for supporting the medical equipment, gripping means for gripping the medical equipment and a vertical member for joining the gripping and supporting means. The gripping means are constructed so as to allow the medical equipment to be quickly removed and conversely to be quickly mounted to the bracket. Coupling means are provided for mounting the bracket to support members. The coupling means are adapted to allow the bracket to mount to support members which are vertically, horizontally or otherwise oriented.

3 Claims, 2 Drawing Sheets

FIG. 3
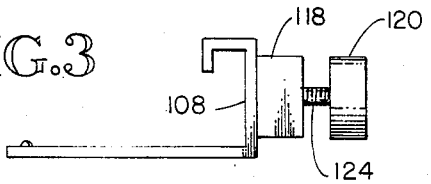
FIG. 4
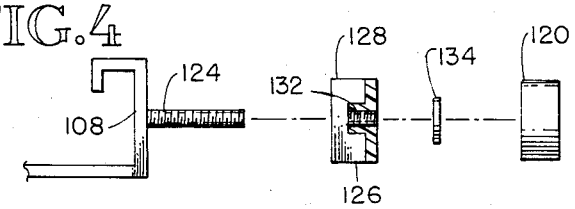
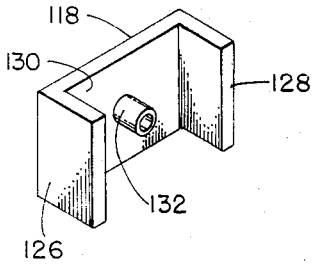
FIG. 4C
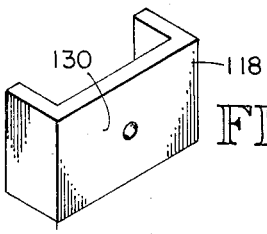
FIG. 4A
FIG. 4B
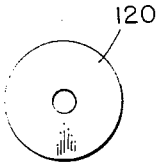
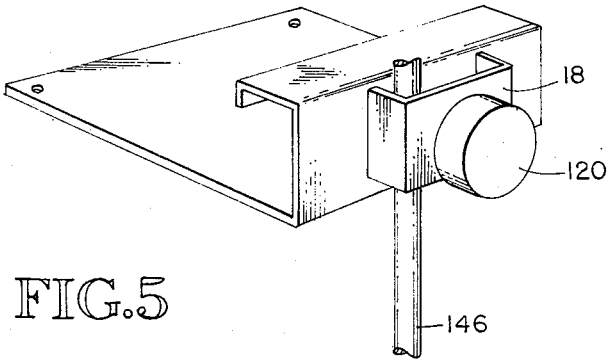
FIG. 5

C-BRACKET FOR MEDICAL EQUIPMENT

TECHNICAL FIELD

The present invention is directed toward support members for medical equipment and, more particularly, toward an improved C-bracket for releasably supporting medical test and monitoring equipment.

BACKGROUND OF THE INVENTION

Rapid advancements in medical technology have made medical monitoring and testing equipment more portable, reliable and, consequently, desirable in all phases of patient treatment. As a result of these advancements, it has become desirable to provide constant monitoring of patient status. In order to do this, the medical equipment for monitoring patient status must be proximate the patient at all times during patient treatment. Hence, the medical equipment must be portable and transportable such that it can be readily moved from one location to another with the patient. However, while the patient is at a rest location it is desirable to mount the medical equipment. It is, therefore, desirable to provide a mounting device for medical equipment which allows the equipment to be quickly and easily removed such that it may be transported with a patient.

Further, it is noted that the cost of hospital services is constantly increasing. Foremost of these costs is the cost for room within the hospital. Hospital services, equipment manufactures, and practitioners are constantly seeking to utilize hospital space more efficiently. It is, therefore, desirable to provide a bracket for supporting hospital equipment which can be readily mounted upon support structures in spaces which are otherwise unused, thereby not requiring its own support structure for mounting.

Along these lines, it is likewise desirable that the bracket for supporting the medical equipment is not only adapted to mount to various support structure but is also adapted to be secured to the support structure in a variety of orientations such that the orientation of the support structure need not affect the orientation of the medical equipment which is supported by the bracket.

DISCLOSURE OF THE INVENTION

The aforementioned disadvantages of the prior art are solved by the present invention which provides an improved bracket for use with medical monitoring and test equipment. Medical monitoring and test equipment which is advantageously used with the subject invention is of the type which includes a handle secured to the equipment and spaced therefrom. The apparatus of the present invention includes a bracket which has a substantially planar horizontal supporting surface for supporting the medical equipment. The bracket includes a substantially planar vertical surface integral with the horizontal supporting surface, a horizontal connecting portion and a projecting edge for gripping the medical equipment to be supported. The vertical surface is angled to the horizontal support surface at a first predetermined angle. The horizontal connecting portion is integrally constructed with the vertical surface along an edge opposite the coupling edge of the horizontal surface and the vertical surface and is angled to the vertical surface at a second predetermined angle. The projecting edge is integrally coupled to the connecting portion at a third predetermined angle along an edge opposite the coupling edge of the vertical surface. The apparatus further includes means for coupling the bracket to a support member such that the bracket is securely fastened to the support member.

BRIEF DESCRIPTION OF THE DRAWINGS

Apparatus which is considered to be invention is particularly pointed out and distinctly claimed in the numbered paragraphs appended hereto. The invention, however, both as to organization and method of practice, may best be understood from a reading of the following detailed description, taken in conjunction with the drawings, in which:

FIG. 3 is a side view of the bracket which is the subject of the present invention;

FIG. 4 is an exploded view of the coupling means for use with the bracket of the present invention;

FIG. 4*a* is a perspective view of the clamping member of the bracket coupling means;

FIG. 4*b* is a plan view of the clamping nob of the coupling means;

FIG. 4*c* is a perspective view of the clamping element of the coupling means; and FIG. 5 is a perspective view of the bracket coupled to a support member.

BEST MODE FOR CARRYING OUT THE INVENTION

Figure 1:
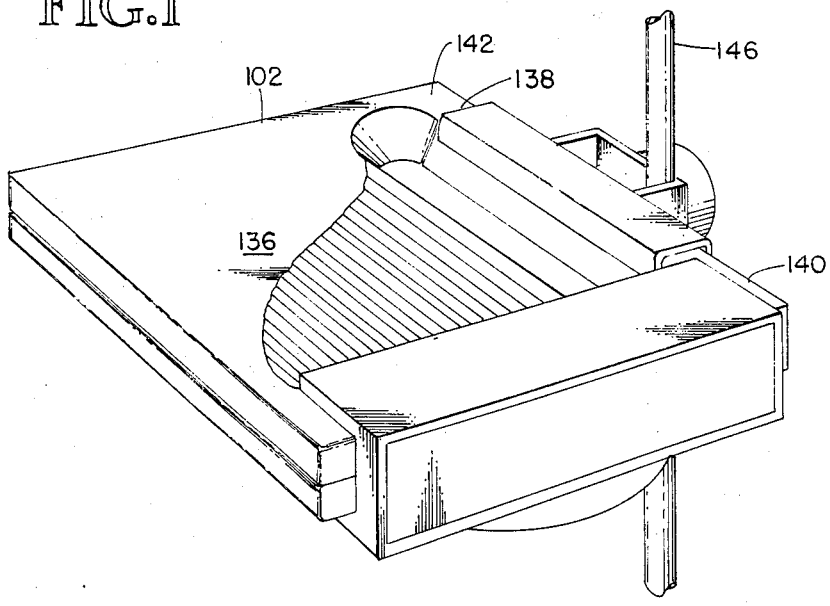
FIG. 1 is a perspective view of the novel bracket when joined with a support member and coupled to medical equipment.
Figure 2:
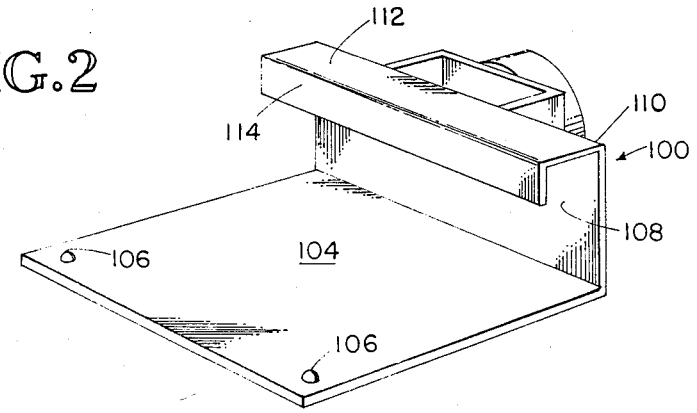
FIG. 2 is a perspective view of the bracket which is the subject of the present invention.

The improved C-bracket of the subject invention is shown generally as bracket 100 adapted for supporting a patient monitoring device 102. In the preferred embodiment, monitoring device 102 comprises a pulse oximeter for determining the amount of oxygen in a patient's body. However, various instruments may be used as device 102 in conjunction with the clamp which is the subject of the present invention.

Monitoring device 102 includes a body portion 136 having a predetermined height H which defines the height of the monitoring device 102. Body portion 136 is integrally constructed with a handle portion 138, the handle portion having a predetermined width W'. Handle portion 138 is spaced from body portion 136 and joined at first and second connecting portions 140 and 142. The spacing of handle 138 from body 136 creates an opening 144 of length L intermediate the handle and the body. It will be apparent to those skilled in the art that handle 138 may be joined with body 136 at only one connecting portion, although two are preferred to add rigidity to the structure.

Bracket 100 includes a substantially planar, rectangular-shaped horizontal supporting surface 104 which is adapted to support the weight of the monitoring device 102. Support surface 104 has a width W which is slightly less than the length L of opening 144.

Supporting surface 104 includes a plurality of support elements 106 spaced about support surface 104. In the preferred embodiment, supporting elements 106 comprise resilient support members which frictionally engage monitoring device 102 to thereby prevent slippage of the device when mounted in bracket 100.

Bracket 100 also includes a substantially planar vertical surface 108 which is integrally connected with support surface 104 at approximately a 90° angle thereto. Vertical surface 108 is a substantially planar, rectangular-shaped surface having a predetermined height H approximately equal to the height H of the monitoring device 102 which it is adapted to support. Vertical surface 108 also has a width H which is substantially equal to the width of horizontal support surface 104.

Bracket 100 also includes a gripping portion 110 which is comprised of a horizontal connecting portion 112 and a projecting edge 114. Horizontal connecting portion 112 is integrally connected to vertical surface 108 at a predetermined angle thereto, which angle is shown in the subject invention as approximately 90°. Horizontal connecting element 112 has a length which is slightly less than the length L of opening 144 and a width which is slightly greater than the width W' of handle 138.

Projecting edge 114 is integrally connected with horizontal connecting portion 112 at a predetermined angle thereto, which in the subject invention is disclosed as approximately 90°. Projecting edge 114 also has a length which is approximately equal to the length of connecting portion 112. Additionally, projecting edge 114 has a width which is substantially less than the length of vertical surface 108. Gripping portion 110 is provided for gripping the handle 138 of monitoring device 102 when the device is inserted in the bracket for support.

It will be appreciated by those skilled in the art that the bracket described above is adapted for quick placement and removal of monitoring device 102 thereby facilitating use of the bracket in combination with medical devices in the hospital environment. The bracket of the subject invention is particularly suited for use in the intensive care unit where constant monitoring is essential and where the patient and instrument may be required to move quickly to other hospital locations.

Bracket 100 also includes a novel means for mounting to a support structure 146. The mounting means generally includes a clamping bracket 118, a clamping nob 120 and a threaded rod 124. Rod 124 is permanently mounted to vertical surface 108. In the preferred embodiment, rod 124 is threaded into a threaded well of vertical surface 108 and permanently sealed therein, as with cement sealer or other permanent sealer. It will be appreciated, however, that other methods for mounting threaded rod 124 to vertical surface 108 may be substituted therefore. As an example, threaded rod 124 may be made an integral part of vertical surface 108.

Clamping nob 120 includes a cylindrical threaded chamber 122 which is adapted to mate with threaded rod 124. Clamping nob 120 thereby acts to engage and clamp the clamping bracket to the support structure 146 and the vertical surface 108 by engaging rod 124. While nob 120 is shown and described as a nob structure herein, a variety of handle structures can be readily substituted therefor.

Clamping bracket 118 includes a clamping surface 130, a support shaft 132 and first and second projecting portions 126 and 128. Projecting portions 126 and 128 are adapted to abut vertical surface 108 thereby spacing clamping surface 130 from vertical surface 108. Cylindrical support shaft 132 extends from the center of clamping surface 130 in the same direction as first and second projecting portions 126 and 128. Cylindrical support shaft 132 has a cylindrical hole therethrough of size adapted for receiving threaded rod 124. Cylindrical support shaft 132 is provided for reinforcing clamping bracket 118 at the interface between the clamping bracket and the threaded rod.

In operation, threaded rod 124 is placed through the hole of support shaft 132 in a manner such that first and second projecting portions 126 and 128 of clamping bracket 118 extend toward vertical support surface 108. Support structure 146 is placed intermediate clamping bracket 118 and vertical surface 108. A washer 134 is placed over the rod intermediate clamping bracket 118 and clamping nob 120. The clamping nob 120 is secured to threaded rod 124 in a manner to provide a clamping force between clamping bracket 118, support structure 146 and vertical surface 108.

It will be appreciated by those skilled in the art that clamping bracket 118 may be turned in a variety of orientations to allow for mounting of bracket 100 to vertical, as well as horizontal, support structure. Further, it is apparent that projecting portions 126 and 128 prevent twisting of the clamp vis-a-vis the support structure, which twisting could result in loosening of nob 120 and/or slippage of the bracket from the support structure.

While only several presently preferred embodiments of our novel bracket have been disclosed in detail herein, it will be apparent to those skilled in the art that many modifications and variations can be made without departing from the true scope and spirit of the invention. It is our invention, therefore, by the claims appended hereto, to embody all such modifications and variations.

What is claimed is:

1. Apparatus for supporting medical and test equipment of the type which includes a handle secured to the equipment and spaced therefrom, said apparatus comprising:

a bracket having a substantially planar horizontal supporting surface for supporting the equipment, said bracket including a substantially planar vertical surface integral with said horizontal supporting surface, a horizontal connecting portion and a projecting edge for gripping the equipment to be supported, said vertical surface being angled to said horizontal support surface at a first predetermined angle, said horizontal connecting portion being integrally coupled to said vertical surface along an edge opposite the coupling edge of said horizontal supporting surface and said vertical surface at a second predetermined angle, said projecting edge being integrally coupled to said connecting portion at a third predetermined angle along an edge opposite the coupling edge of said vertical surface;

a threaded rod securely coupled to said vertical surface of said bracket;

a clamping portion including a clamping surface, a cylindrical support shaft integrally coupled to said clamping surface and first and second projecting edges integrally coupled to opposite sides of said connecting portion, said cylindrical support shaft including a cylindrical aperture therethrough for receiving said threaded rod wherein the circumference of said aperture is slightly greater than the circumference of said threaded rod; and a nob having a cylindrical channel therein, said cylindrical channel being threaded to mate the threads of said threaded rod such tht said nob is securely engageable with said threaded rod.

2. Apparatus as recited in claim 1 wherein said bracket further comprises resilient support members coupled to said horizontal supporting surface for resiliently engaging the medical equipment which said bracket is adapted to engage.

3. Apparatus as recited in claim 2 wherein said first, second and third predetermined angles are all 90° angles.

* * * * *

UNITED STATES PATENT AND TRADEMARK OFFICE

CERTIFICATE OF CORRECTION

PATENT NO. : 4,815,687

DATED : March 28, 1989

INVENTOR(S) : Gary J. Selke; Larry J. Morse

It is certified that error appears in the above-identified patent and that said Letters Patent is hereby corrected as shown below:

In claim 3, column 4, line 65, delete "2", and substitute therefor --1--.

Signed and Sealed this

Twenty-sixth Day of December, 1989

*Attest:*

JEFFREY M. SAMUELS

*Attesting Officer* *Acting Commissioner of Patents and Trademarks*